US008721019B2

(12) United States Patent
Meyer

(10) Patent No.: US 8,721,019 B2
(45) Date of Patent: May 13, 2014

(54) APPARATUS AND METHOD FOR TREATMENT OF PRINTED INK IMAGES

(75) Inventor: Henry Alan Meyer, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 104 days.

(21) Appl. No.: 13/358,755

(22) Filed: Jan. 26, 2012

(65) Prior Publication Data

US 2013/0194332 A1 Aug. 1, 2013

(51) Int. Cl.
*B41J 29/38* (2006.01)

(52) U.S. Cl.
USPC ..... 347/10; 347/101

(58) Field of Classification Search
USPC ..... 347/10, 12, 19, 101, 21, 84, 85, 104; 358/453; 399/341
See application file for complete search history.

(56) References Cited

U.S. PATENT DOCUMENTS

| | | | | |
|---|---|---|---|---|
| 3,661,619 | A | 5/1972 | Surland | |
| 5,764,263 | A * | 6/1998 | Lin | 347/101 |
| 5,850,589 | A * | 12/1998 | Cruz et al. | 399/341 |
| 6,176,574 | B1 * | 1/2001 | Wen et al. | 347/101 |
| 6,259,887 | B1 | 7/2001 | Awano | |
| 6,435,678 | B1 * | 8/2002 | Erdtmann et al. | 347/101 |
| 6,484,009 | B2 | 11/2002 | Furuya et al. | |
| 8,038,280 | B2 | 10/2011 | Scarlata | |
| 2004/0196324 | A1 * | 10/2004 | Tschida | 347/19 |
| 2006/0087700 | A1 * | 4/2006 | Kishi | 358/453 |
| 2009/0034023 | A1 * | 2/2009 | Tsuchihashi | 358/474 |
| 2009/0256896 | A1 | 10/2009 | Scarlata | |
| 2010/0192685 | A1 * | 8/2010 | Sabanovic et al. | 73/290 R |
| 2010/0321434 | A1 * | 12/2010 | Baba | 347/12 |
| 2011/0141180 | A1 | 6/2011 | Doi et al. | |
| 2011/0206841 | A1 | 8/2011 | Sabater Vilella | |

* cited by examiner

*Primary Examiner* — Manish S Shah
*Assistant Examiner* — Yaovi Ameh
(74) *Attorney, Agent, or Firm* — Maginot, Moore & Beck, LLP

(57) ABSTRACT

An inkjet printer ejects ink drops onto a surface of a print medium to form an ink image. A fluid emitter sprays fluid onto the ink image. The fluid sprayed on the ink image reduces or eliminates an offset of ink from the ink image during additional processing of the print medium after the ink image is printed on the print medium.

6 Claims, 6 Drawing Sheets

APPARATUS AND METHOD FOR TREATMENT OF PRINTED INK IMAGES

TECHNICAL FIELD

This disclosure relates generally to imaging devices that eject ink to form images on print media, and, more particularly, to devices that treat ink images after the images are printed on a print medium.

BACKGROUND

In general, inkjet printing machines or printers include at least one printhead that ejects drops of liquid ink onto recording media or onto an image receiving member surface. A phase change inkjet printer employs phase change inks that are in the solid phase at ambient temperature, but transition to a liquid phase at an elevated temperature. A printhead ejects drops of the melted ink to form an ink image. The ink can be ejected directly onto print media or onto an image receiving member surface, such as a rotating drum or moving belt, before the image is transferred to print media. Once the ejected ink is transferred to the print medium the ink droplets quickly solidify to form an ink image.

The media used in inkjet printers are typically provided in sheet or web form. A media sheet printer typically includes a supply drawer that houses a stack of media sheets. A feeder removes a sheet of media from the supply and directs the sheet along a feed path past a printhead so the printhead ejects ink directly onto the sheet. In a web printer, a continuous supply of media, typically provided in a media roll, is entrained onto rollers that are driven by motors. The motors and rollers pull the web from the supply roll through the printer to a take-up roll. As the media web passes through a print zone opposite the printhead or heads of the printer, the printheads eject ink onto the web. Along the feed path, tension bars or other rollers remove slack from the web so the web remains taut without breaking.

The processing of a print medium often continues after an ink image is printed onto a media sheet or media web. For example, in a cut sheet printing system, the media sheets can be sorted, collated, stapled, bound, or otherwise organized after ink images are printed on the media sheets. For a continuous media web, additional processing includes a cutting process whereby sections of the media web are cut into individual pages such as pages in a book or magazine. Further, some printers generate multiple printed pages across a width of a print medium that correspond to two or more tandem pages. For example, in a "two up" print mode, two pages are printed in tandem across a width of a single media sheet or a media web. The print medium is cut longitudinally to separate the tandem pages. Various devices that are referred to as "finishing units" perform the additional processing on the print medium after the inkjets have formed the ink images on the print medium.

One challenge that arises with the use of finishing units is that some ink in the ink images may offset from the print medium and transfer onto a roller, baffle, or other component in the finishing unit. Ink offset reduces the quality of printed images in at least two ways. First, an ink image that experiences offset has a degraded image quality because the print medium loses a portion of the ink in the ink image. Second, the offset ink may re-transfer onto another page and contaminate the ink image on the other page. Consequently, improvements to inkjet printers that reduce or eliminate the offset of ink from printed ink images would be beneficial.

SUMMARY

In one embodiment, a method of operating an inkjet printer has been developed. The method includes moving a print medium through a print zone in a process direction, ejecting a plurality of ink drops from a plurality of inkjets in the print zone onto a surface of the print medium to form an ink image, and spraying a fluid directly onto the ink image on the print medium surface with a fluid emitter located after the print zone in the process direction.

In another embodiment, an inkjet printer has been developed. The printer includes a media transport configured to move a print medium in a process direction through the printer, a plurality of inkjets in a print zone configured to eject ink drops onto the print medium, a fluid emitter located after the print zone in the process direction, and a controller operatively connected to the media transport, the plurality of inkjets, and the fluid emitter. The controller is further configured to activate the media transport to move the print medium through the print zone and past the fluid emitter in the process direction, generate a plurality of firing signals to eject a plurality of ink drops from the plurality of inkjets in the print zone onto a surface of the print medium to form an ink image, and activate the fluid emitter to spray a fluid directly onto the ink image.

In another embodiment, an inkjet printer has been developed. The inkjet printer includes a media transport configured to move a print medium in a process direction through the printer, a plurality of inkjets in a print zone configured to eject ink drops onto the print medium, a first fluid emitter located after the print zone in the process direction, a second fluid emitter located after the print zone in the process direction and opposed to the first fluid emitter, and a controller operatively connected to the media transport, the plurality of inkjets, the first fluid emitter, and the second fluid emitter. The controller is further configured to activate the media transport to move the print medium through the print zone in the process direction, generate a first plurality of firing signals to eject a first plurality of ink drops from the plurality of inkjets onto a first surface of the print medium to form a first ink image, generate a second plurality of firing signals to eject a second plurality of ink drops from the plurality of inkjets onto a second surface of the print medium to form a second ink image, activate the first fluid emitter to spray fluid directly onto the first ink image, and activate the second fluid emitter to spray fluid directly onto the second ink image.

DETAILED DESCRIPTION

Figure 1:
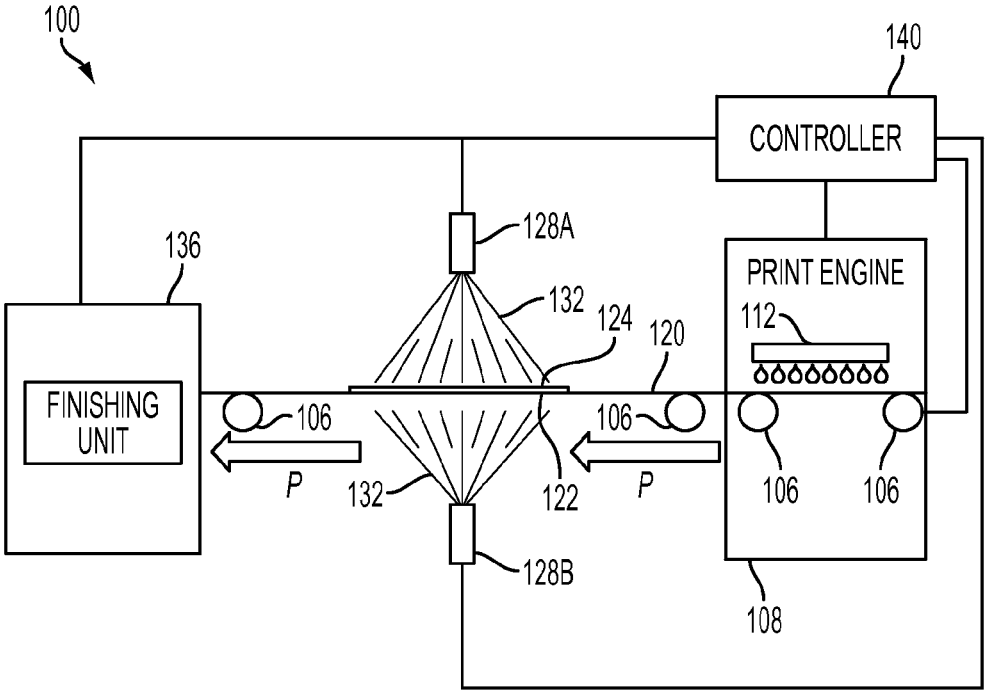
FIG. 1 is a schematic diagram of an inkjet printer having a fluid emitter that sprays a fluid onto an ink image formed on one side of a print medium in a simplex print mode.

For a general understanding of the environment for the system and method disclosed herein as well as the details for the system and method, the accompanying drawings are referenced. In the drawings, like reference numerals have been used throughout to designate like elements. As used herein the term "printer" refers to any device that forms ink images on print media and includes photocopiers, facsimile machines, multifunction devices, as well as direct and indirect inkjet printers. An image receiving surface refers to any surface that receives ink drops, such as print media, which includes paper sheets or a continuous paper roll, and intermediate imaging surfaces, such as image drums or belts.

When one or more inkjets eject ink drops onto a print medium, a percentage of the surface of the print medium receiving the ink is covered by ink while the remaining portion of the area is free of ink. The term "coverage density" refers to the ratio of the print medium covered by ink to the total area of a particular area of the medium that includes the covered area. The coverage density can be described as a percentage, with 100% coverage density meaning the area is fully covered in ink and 0% coverage density meaning the area is free of ink. In some configurations, a printed page includes areas that are printed with a 100% coverage density, and other areas that are left unprinted with a 0% coverage density. Additionally, the printer can print an area with an intermediate coverage density by ejecting ink drops in a dithered pattern. As used herein, the term "dither" refers to an operation for ejecting ink drops in a pattern that interleaves with blank portions of the receiving member. A common example of a dithered pattern is a "checkerboard" pattern where ink drops are placed on the image surface as alternating pixels that are interleaved with blank areas. Various dither patterns can be used to generate images with different coverage densities.

Figure 2:
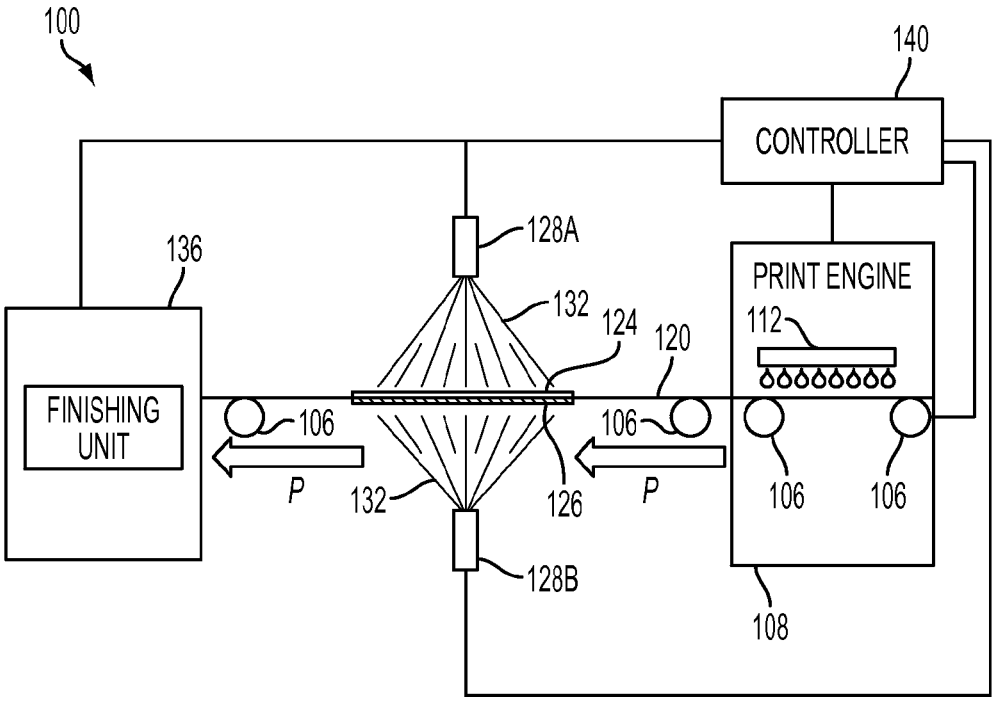
FIG. 2 is a schematic diagram of the inkjet printer of FIG. 1 with fluid emitters that spray fluid onto ink images formed on two sides of the print medium in a duplex print mode.

FIG. 1 and FIG. 2 depict one embodiment of an inkjet printer 100. FIG. 1 depicts the printer 100 operating in a simplex print mode to produce ink images on only one side of the web 120, and FIG. 2 depicts the printer 100 operating in a duplex print mode to produce ink images on two sides of the web 120. The inkjet printer 100 includes a print engine 108, fluid emitters 128A and 128B, and a finishing unit 136. A controller 140 is operatively connected to the media transport 106 that moves the print medium 120, which is depicted in FIG. 1 and FIG. 2 as a continuous media web, a print engine 108, fluid emitters 128A and 128B, and the finishing unit 136 to direct a printing process. A print medium 120 moves through the print engine 108, by the fluid emitters 128A and 128B, and through the finishing unit 136 in a process direction P. In a printer embodiment that prints onto individual media sheets, the media transport 106 can be configured with conveyor belts and other members to move individual media sheets through the printer 100 in the process direction P.

Operation and control of the print engine 108, fluid emitters 128A and 128B, and finishing unit 136 of the printer 100 is performed with the aid of the controller 140. The controller 140 can be implemented with general or specialized programmable processors that execute programmed instructions. The instructions and data required to perform the programmed functions are stored in memory associated with the processors or controllers. The processors, their memories, and interface circuitry configure the controllers and/or print engine to perform the functions, such as the difference minimization function, described above. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

In the printer 100, the print engine 108 includes an inkjet array 112 and an optional duplexing unit 116. In a typical embodiment, the inkjet array 112 is formed from one or more printheads, each of which includes a plurality of inkjets. The printheads are arranged in a print zone, and the print medium 120 moves through the print zone in the process direction P. Each inkjet in the inkjet array 112 is configured to eject drops of a liquid ink onto a surface of the print medium 120 as the print medium moves through the print zone.

During an imaging operation, the controller 140 generates electrical signals that activate the inkjets in the inkjet array 112. In printer 100, the controller receives digital image data corresponding to one or more ink images that the print engine 108 prints onto the print medium 120. The image data can include binary data in a rasterized image format, printer command data in a page description language (PDL), ASCII text data, or any other digital data format known to the art for controlling the formation of ink images in a printer. The controller 140 generates the electrical signals for operating the print engine 108 with reference to the received image data to form ink images on the web 120. The electrical signals are used by the print engine to eject ink drops from selected inkjets in the inkjet array 112 at selected times to generate a two-dimensional pattern of ink drops on the surface of the print medium 120 as the print medium 120 moves through the print zone.

As used herein, the term "ink image" refers to any arrangement of ink formed on the print medium by one or more inkjets. An ink image includes both printed text and graphics, and can include one or more colors of ink. An ink image corresponding to a single printed page can include different regions incorporating text, graphics, photographs, or any other arrangement of ink formed by the inkjet array 112.

In one embodiment, the print engine 108 and the inkjet array 112 are configured to form printed ink images using phase change ink. A phase change ink refers to any form of ink that is substantially solid at room temperature and substantially liquid when heated to a phase change ink melting temperature for jetting onto the imaging receiving surface. The phase change ink melting temperature can be any temperature that is capable of melting solid phase change ink into liquid or molten form. In one embodiment, the phase change ink melting temperature is approximately 70° C. to 140° C. In alternative embodiments, the ink utilized in the imaging device can comprise UV curable gel ink. Gel ink is also heated to affect the viscosity of the ink before the ink is ejected by the inkjets of the printhead.

The print engine 108 and inkjet array 112 include one or more heaters that melt the phase change ink for ejection onto the print medium 120 in the form of melted ink drops. The melted ink drops cool and solidify on the surface of the print medium 120 to form ink images. The print engine 108 can include additional heaters and pressure rollers to spread the ink drops on the surface of the print medium before the melted phase change ink solidifies. The printer 100 controls the temperature of the print medium 120 to enable the phase change ink printed images to solidify prior to the print medium 120 moving past the fluid emitters 128A and 128B in the process direction P.

In the example of FIG. 1, the print engine 108 prints an ink image 124 on only one surface of the print medium 120. This mode of print engine operation is known as simplex print operation. In a simplex print mode of operation, the print engine 108 leaves the surface of a second side 122 of the print medium without an ink image. In the example of FIG. 2, the print engine 108 operates in a duplex print mode to print ink images 124 and 126 on both sides of the print medium 120. The duplexed ink images are typically aligned in the process direction P to correspond to two printed sides of a single page in a document.

In some printer embodiments capable of operating in the duplex print mode, a duplexing unit (not shown) is included that inverts the print medium 120 and returns a second side of the print medium 120 past the inkjet array 112 for duplex printing before the print medium 120 passes the fluid emitters 128A and 128B. Another printer embodiment capable of duplex printing operation includes two print engines that each print an ink image on one side of the print medium 120 to produce a duplexed image before the print medium 120 passes the fluid emitters 128A and 128B. For the purposes of this document, any printer configuration that ejects ink drops onto both sides of a media sheet is referred to as a duplex printer. As is known in the art, many printers that are capable of printing in a duplex mode are also configurable to print in a simplex mode. Still other printer embodiments only print in a simplex mode.

Referring again to FIG. 1, the fluid emitters 128A and 128B are positioned after the print engine 108 and before the finishing unit in the process direction P. The print medium passes between the fluid emitters 128A and 128B, and each fluid emitter is configured to spray a fluid 132 onto only one side of the print medium 120. In FIG. 1, the fluid emitter 128A sprays fluid 132 directly onto the ink image 124 on the printed side of the print medium 120, and fluid emitter 128B sprays fluid 132 directly onto the non-imaged side 122. As used in this document, the "direct spraying" of the fluid 132 describes operation of the fluid emitters 128A and 128B to spray the fluid 132 in a manner where substantially all of the fluid 132 follows a direct path to only one side of the print medium 120. As described in more detail below, the fluid emitters 128A and 128B can be operated to apply different amounts of fluid 132 directly to different regions of ink images formed on the print medium 120.

In the printer 100, the fluid 132 sprayed by the fluid emitters 128A and 128B is water. A pump or other pressurized source (not shown) supplies the water to one or more nozzles in the fluid emitters 128A and 128B. Each of the fluid emitters 128A and 128B is configured to spray the water 132 directly onto substantially all of the surface area of one side of the print medium 120, including the entire surface of an ink image that is printed on the print medium 120. The controller 140 is operatively connected to the fluid emitters 128A and 128B to control the spray of water 132 toward each side of the print medium 120. In one embodiment, the controller 140 selectively dilates and contracts outlets in the fluid emitters 128A and 128B to control the output rate of the water 132 through each of the fluid emitters 128A and 128B.

In FIG. 1, the printer 100 sprays water 132 from the fluid emitter 128A onto the ink image 124 formed on one side of the print medium 120. When the printer 100 prints onto a porous material, such as paper, the print medium 120 absorbs a portion of the water 132. Another portion of the water 132 collects on an upper surface of the ink image 124. As described in more detail below, the water formed on the ink image 124 reduces or eliminates offset of the ink image 124 from the print medium 120 as the finishing unit 136 processes the print medium 120. In some embodiments, the controller 140 operates the fluid emitter 128B to spray water 132 onto the non-printed side 122 of the print medium 120, while in other embodiments, the controller only operates the emitter 128A to spray the fluid on only the side of the media printed with an ink image. Fluid may need to be sprayed on both sides of the print medium 120 to reduce local differences in the moisture content of the print medium 120. As is known in the art, uneven moisture content in the print medium 120 can result in curling, cockling, waviness, or other distortions to the shape of the print medium. The water 132 sprayed directly onto both sides of the print medium reduces or eliminates distortion of the print medium due to uneven moisture content.

In FIG. 2, the controller 140 operates the fluid emitter 128A to spray fluid 132 directly onto the ink image 124 and operates the fluid emitter 128B to spray fluid 132 directly onto the ink image 126 at substantially the same time. The sprayed fluid 132 collects on the surface of both of the ink images 124 and 126. The fluid on the surface of the ink images 124 and 126 reduces or eliminates offset from both of the ink images 124 and 126 as the finishing unit 136 processes the print medium 120.

In printer 100, both of the fluid emitters 128A and 128B operate substantially simultaneously to spray the fluid 132 directly onto either side of the print medium 120. The controller 140 can vary an output rate of fluid 132 through each of the fluid emitters 128A and 128B while both of the fluid emitters spray fluid 132. For example, in FIG. 1, the controller 140 operates the fluid emitter 128A to spray fluid 132 at a higher output rate than an output rate of the fluid emitter 128B. Consequently, a larger amount of fluid 132 lands on the ink image 124 and the printed side of the print medium 120 than on the non-printed side 122.

Referring to FIG. 1 and FIG. 2, the print medium 120 enters the finishing unit 136 after passing the fluid emitters 128A and 128B in the process direction P. The finishing unit 136 includes one or more rollers, baffles, trays, and other components that engage the print medium 120. In a continuous web printer, the finishing unit 136 can include one or more cutting devices that cut the continuous web into a plurality of printed sheets. In a cut sheet printer, the print medium 120 is an individual sheet, and the finishing unit stacks and collates multiple media sheets during a print job.

Figure 3:
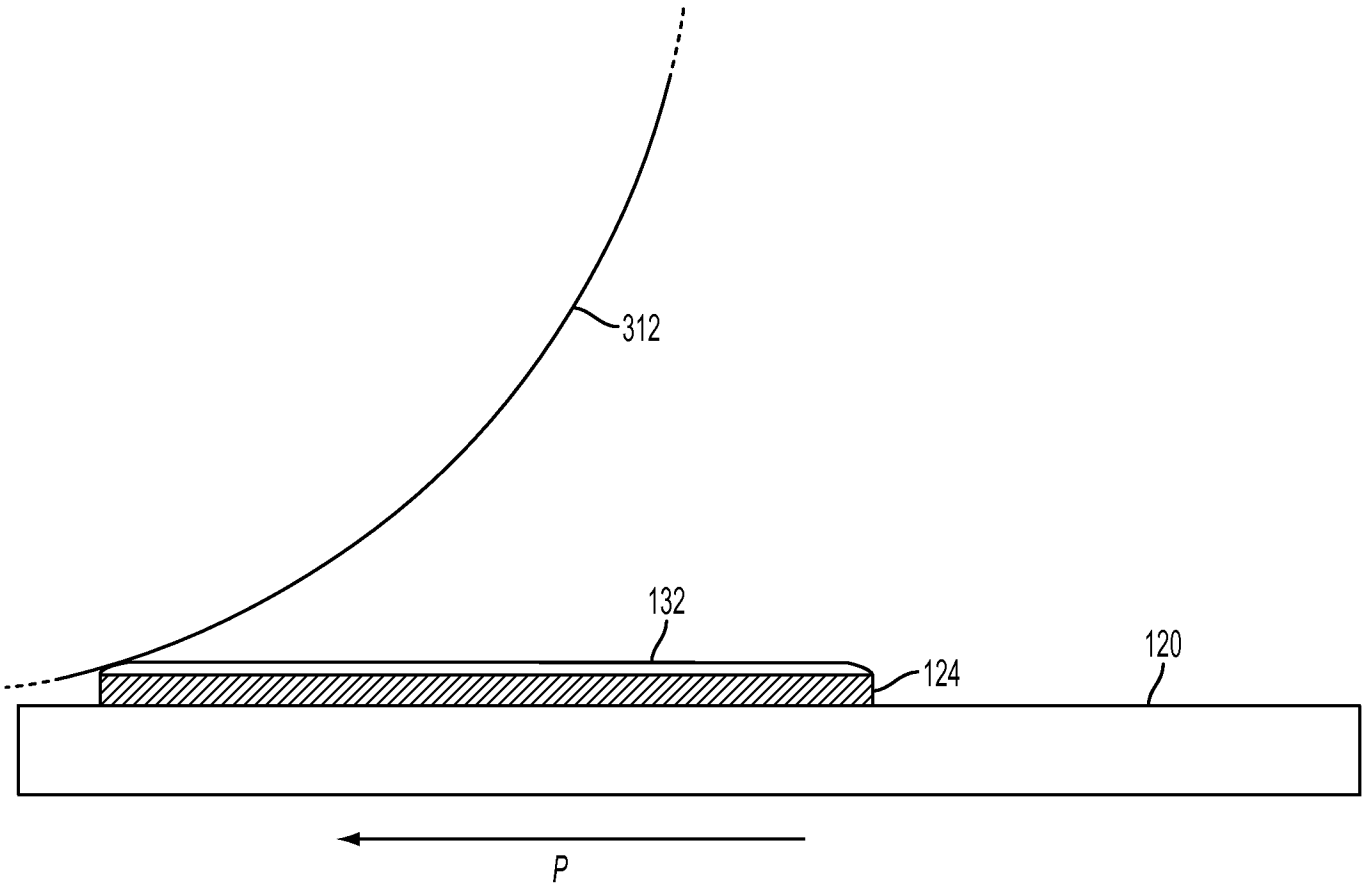
FIG. 3 is a side view of a roller in a finishing unit that engages a print medium with a printed ink image.

FIG. 3 depicts an example of a roller in the finishing unit 136 and the print medium 120. In the finishing unit, the print medium 120 moves in the process direction P to engage the surface of a roller 312. A layer of the fluid 132 is formed on the surface of the ink image 124. As the print medium 120 engages the roller 312, the surface of the roller 312 engages the fluid 132 instead of engaging the ink image 124 directly. The fluid 132 forms a barrier that reduces or eliminates adhesion and potential offset between the ink image 124 and the roller 312. Thus, the fluid sprayed onto the surface of ink images in the printer 100 reduces or eliminates offset between the ink images and components in the finishing unit 136. While FIG. 3 depicts a layer of water 132 that substantially covers the ink image 124, the water 132 can also form as a plurality of drops that partially cover the surface of the ink image 124. The water drops also form a barrier that reduces the size of contiguous areas of contact between the ink image 124 and the roller 312. Consequently, the water drops also reduce adhesion and a likelihood of offset between the ink image 124 and the roller 312.

In the embodiment of printer 100, the fluid 132 is water. After the print medium 120 passes through the finishing unit 136, any remaining water 132 evaporates from the surface of the ink image 124. Other embodiments spray different fluids onto the ink images to form a barrier between the ink images and components in the finishing unit 136. For example, silicone can be sprayed onto the ink image to reduce or eliminate contamination of finishing units. The silicone formed on the ink images reduces adhesion between ink on the print medium and components in the finishing unit. The silicone evaporates from the surface of the printed ink images and the print medium after the finishing unit processes the print medium.

Figure 4:
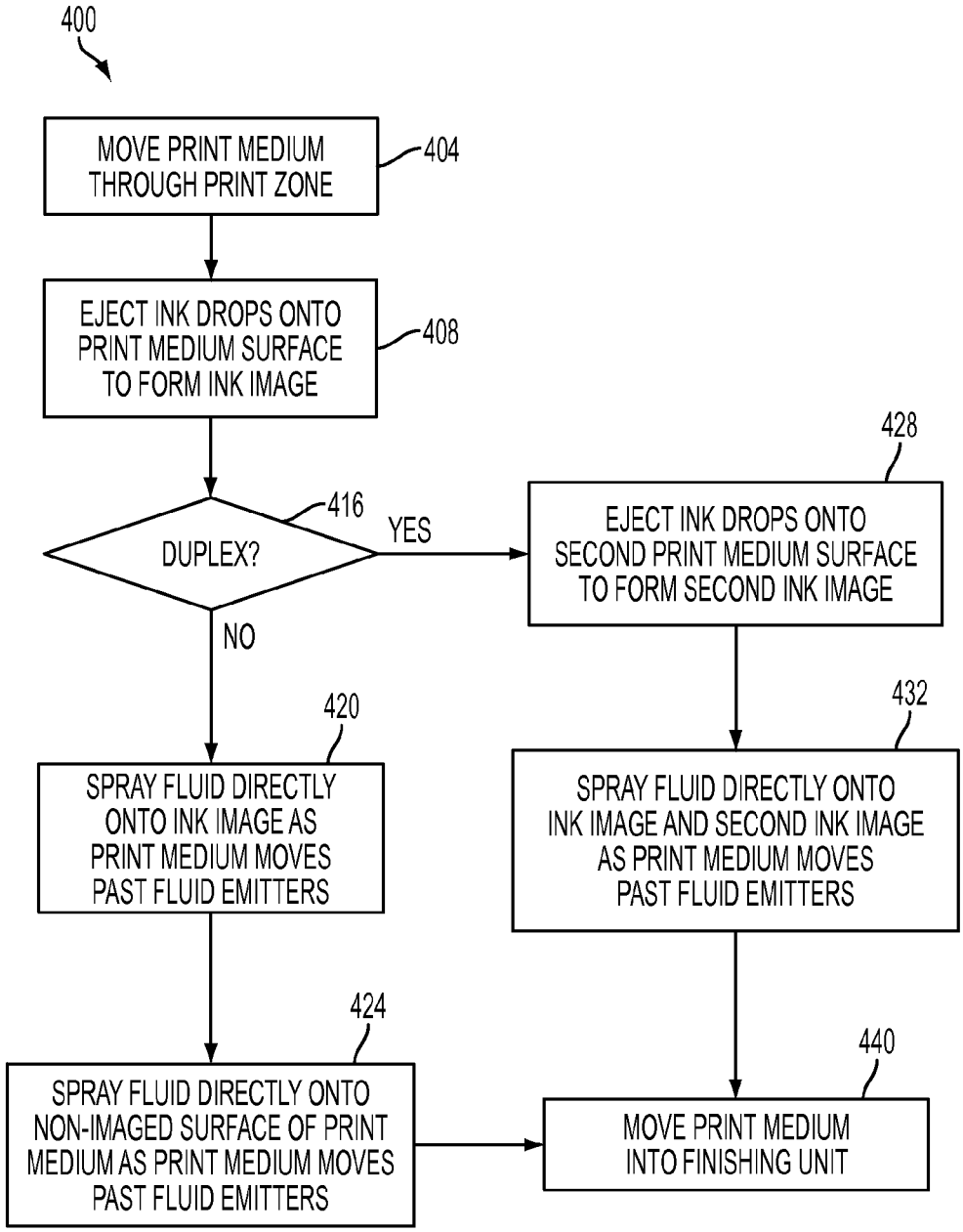
FIG. 4 is a block diagram of a process for operating an inkjet printer that sprays a fluid onto printed ink images.

FIG. 4 depicts a process 400 for printing images in an inkjet printer. In the discussion below, a reference to the process 400 performing a function or action refers to a controller executing programmed instructions stored in a memory to operate one or more components of the printer to perform the function or action. Process 400 is described in conjunction with printer 100 for illustrative purposes. Process 400 begins by moving a print medium through a print zone (block 404) and ejecting ink drops onto a surface of the print medium to form an ink image (block 408). As depicted above in FIG. 1 and FIG. 2, the media transport 106 moves the print medium 120 moves past the inkjet array 112 in the print engine 108 in the process direction P. The controller 140 generates electrical signals that operate the print engine 108 and the inkjet array 112 with reference to received digital image data. As noted above, the inkjet array can be configured to eject melted phase change ink drops onto the print medium 112.

In a simplex print mode, the printer 100 only prints an ink image on one side of the print medium 120 during process 400, instead of printing on two sides in a duplex mode (block 416). Process 400 continues as the print medium 420 moves past the fluid emitters 128A and 128B. As print medium 120 passes the fluid emitters 128A and 128B, the controller 140 activates at least one of the fluid emitters, such as fluid emitter 128A in FIG. 1, to spray fluid 132 onto the printed ink image 124 (block 420). In a printer that prints images on a continuous media web, the controller 128 optionally activates and deactivates the fluid emitter 128A so that the fluid 132 is only sprayed onto sections of the media web that include ink images and not onto blank interstitial regions of the media web. The controller 140 can optionally activate the second fluid emitter, such as fluid emitter 128B in FIG. 1, to spray the fluid 132 onto the non-imaged side of the print medium 120 to balance the moisture content of the print medium 120 (block 424).

In a duplex print mode, the printer 100 prints an ink image on both sides of the print medium 120 during process 400 (block 416). The controller 140 activates inkjets to ejecting ink drops onto the second surface of the print medium to form a second ink image (block 428). In one duplex printer embodiment, the print engine 108 includes a duplexing unit to invert the print medium to pass the second side of the print medium past the inkjet ejectors 112. In another duplex printer embodiment, a second inkjet array is located in the process direction P to print the second ink image onto the second side of the print medium 120. The second ink image can be printed before, during, or after the printing of the first ink image.

As print medium 120 passes the fluid emitters 128A and 128B, the controller 140 activates both of the fluid emitters 128A and 128B to spray fluid 132 onto the first printed ink image 124 and the second printed ink image 126, respectively (block 432). In a printer that prints images on a continuous media web, the controller 128 optionally activates and deactivates the fluid emitters 128A and 128B so that the fluid 132 is only sprayed onto sections of the media web that include ink images and not onto blank interstitial regions of the media web. In printer 100, the fluid emitters 128A and 128B both spray the fluid 132 at substantially the same time as the print medium 120 moves in the process direction P.

After spraying the fluid 132 onto the print medium 120 in either a simplex or duplex print mode of operation, the printer 100 moves the print medium 120 into the finishing unit 136 (block 440). The fluid 132 forms a barrier over the printed ink image 124 in a simplex print mode, and over ink images 124 and 126 in the duplex print mode to reduce or eliminate offset of the ink from the print medium as the finishing unit 136 processes the print medium 120.

Figure 5:
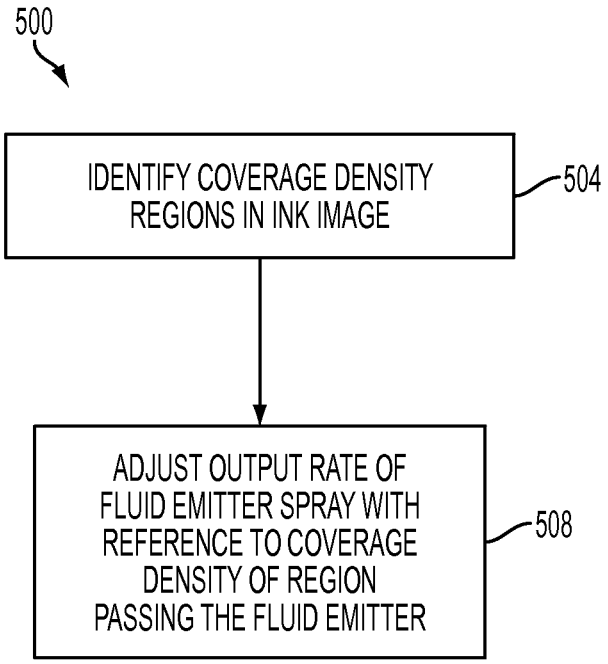
FIG. 5 is a block diagram of a process for adjusting an amount of fluid sprayed onto different regions of an ink image.

During process 400, the controller 140 is configured to adjust the operation of the fluid emitters 128A and 128B to adjust an output rate of the fluid 132 onto both sides of the print medium 120. The amount of fluid 132 that sprays onto the print medium 120 is proportional to the output rate. FIG. 5 depicts a process 500 for controlling an amount of fluid that is sprayed onto the print medium. Process 500 is performed in conjunction with process 400, and a reference to the process 500 performing a function or action refers to a controller executing programmed instructions stored in a memory to operate one or more components of the printer to perform the function or action. Process 500 is described in conjunction with printer 100 for illustrative purposes.

Figure 6:
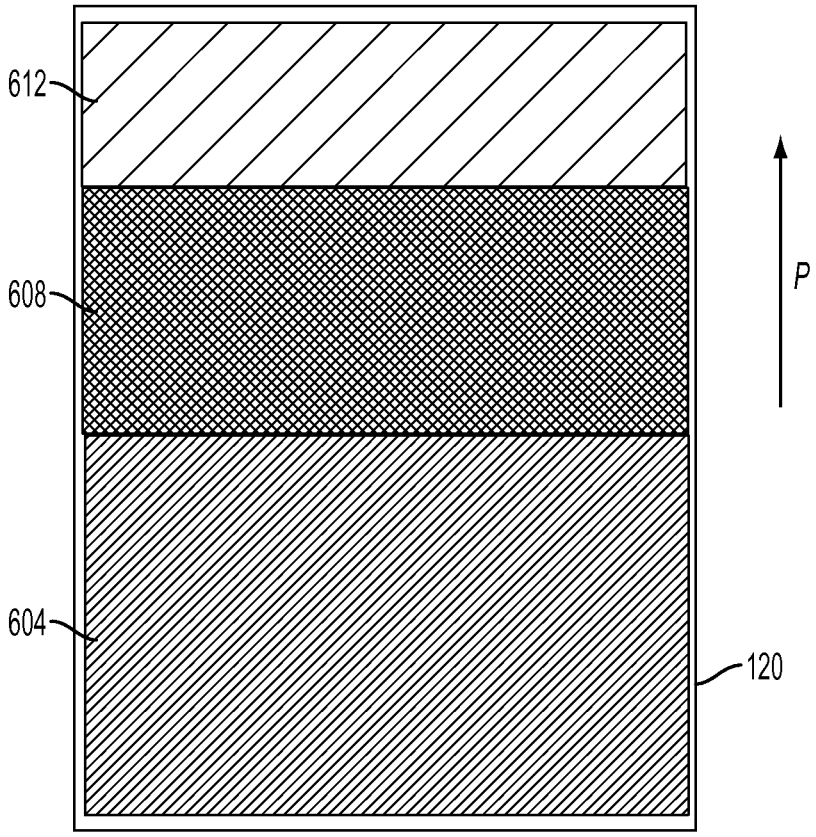
FIG. 6 is an exemplary depiction of regions of an ink image that include different coverage densities.

In process 500, the controller 140 identifies regions of an ink image that have different coverage densities (block 504). In one embodiment, the controller 140 identifies the coverage densities in different regions of the ink image with reference to the same digital image data that the controller uses to print the ink image. FIG. 6 depicts an example of a single page printed on the print medium 120. In the example of FIG. 6, the controller 140 identifies three regions 604, 608, and 612, each of which has different image densities. In one embodiment, the controller 140 segments the image data into the different regions based on an average coverage density over the region of the printed image. For example, in FIG. 6, the region 604 can include black text. Within the region 612, the black text has a coverage density of 100%, while blank areas around the text have a coverage density of 0%. The average coverage density of the entire region 604 is an intermediate percentage between 0% and 100%. In another region 608, the ink image includes a photographic image that has 100% coverage over the entire region. The region 612 includes a dithered printed pattern having another intermediate coverage density. The example of FIG. 6 is merely illustrative, and the controller 140 can identify fewer or greater numbers of regions in the image data. Additionally, some ink images include a substantially uniform coverage density over the entire image. The controller 140 identifies a single coverage density for the entire ink image for the ink images with uniform coverage densities.

After identifying the coverage density in one or more regions in the ink image, the controller 140 adjusts the output rate of the fluid emitter 128A or 128B that sprays the fluid 132 onto the ink image (block 508). In printer 100, the controller 140 selectively dilates and contracts an output valve in each of the fluid emitters 128A and 128B to control the output rate. The controller 140 adjusts the output rate of the fluid emitters 128A and 128B in synchronization with the media transport 106 so that the selected amount of fluid 132 lands on each region of the print medium 120 as the print medium 120 passes the fluid emitters 128A and 128B. In one embodiment, the controller 140 identifies the output rate for each of the fluid emitters 128A and 128B with reference to a look up table (LUT) stored in a memory. The LUT includes predetermined fluid output rates for the coverage densities identified in the image data.

In process 500, the controller 140 increases the fluid output rate through the fluid emitters 128A and 128B when spraying the fluid 132 onto regions of the ink image that have a higher coverage densities. This type of operation helps ensure that a sufficient amount of the fluid 132 covers the surface of the ink image to reduce or eliminate offset when the print medium is processed in the finishing unit 136. The fluid output rate and amount of fluid sprayed on the print medium 120 is decreased when spraying the fluid 132 onto regions of the ink image that have lower coverage densities to prevent distortion of the print medium 120 due to absorption of the fluid 132.

It will be appreciated that variants of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

I claim:

1. An inkjet printer comprising:

a media transport configured to move a print medium in a process direction through the printer;

a plurality of inkjets in a print zone configured to eject ink drops onto the print medium;

a first fluid emitter located after the print zone in the process direction;

a second fluid emitter located after the print zone in the process direction and opposed to the first fluid emitter; and a controller operatively connected to the media transport, the plurality of inkjets, the first fluid emitter, and the second fluid emitter, the controller being further configured to:

activate the media transport to move the print medium through the print zone in the process direction;

generate a first plurality of firing signals with reference to first image data to eject a first plurality of ink drops from the plurality of inkjets onto a first surface of the print medium to form a first ink image;

generate a second plurality of firing signals with reference to second image data to eject a second plurality of ink drops from the plurality of inkjets onto a second surface of the print medium to form a second ink image;

operate the first fluid emitter with reference to the first image data to spray fluid directly onto the first ink image; and operate the second fluid emitter with reference to the second image data to spray fluid directly onto the second ink image.

2. The printer of claim 1 wherein the fluid consists essentially of water.

3. The printer of claim 1 further comprising:

a supply of melted phase-change ink operatively connected to the plurality of inkjets to enable the plurality of inkjets to eject melted phase-change ink onto the print medium.

4. The printer of claim 1 further comprising:

a finishing unit located after the first fluid emitter and the second fluid emitter in the process direction, the media transport being configured to move the print medium to the finishing unit so a surface of at least one component in the finishing unit engages the fluid sprayed onto the first ink image and the fluid sprayed onto the second ink image.

5. The printer of claim 1 wherein the fluid evaporates from the first ink image and the second ink image after the finishing unit processes the print medium.

6. The printer of claim 1, the controller being further configured to:

generate the first plurality of firing signals with reference to first image data;

identify a first coverage density of the first ink image in a first region of the first ink image with reference to the first image data;

identify a second coverage density of the first ink image in a second region of the first ink image with reference to the first image data, the second coverage density being less than the first coverage density;

adjust the first fluid emitter with reference to the identified first coverage density to spray fluid directly onto the first region of the first ink image at a first output rate;

adjust the first fluid emitter with reference to the identified second coverage density to spray the fluid onto the second region of the first ink image at a second output rate, the first output rate being greater than the second output rate;

generate the second plurality of firing signals with reference to the second image data;

identify a third coverage density of the second ink image in a first region of the second ink image with reference to the second image data;

identify a fourth coverage density of the second ink image in a second region of the second ink image with reference to the second image data, the fourth coverage density being less than the third coverage density;

adjust the second fluid emitter with reference to the identified third coverage density to spray fluid directly onto the first region of the second ink image at a third output rate; and adjust the second fluid emitter with reference to the identified fourth coverage density to spray fluid directly onto the second region of the second ink image at a fourth output rate, the third output rate being greater than the fourth output rate.

* * * * *